US005835525A

United States Patent [19]

Thomas

[11] Patent Number: 5,835,525

[45] Date of Patent: Nov. 10, 1998

[54] FURNACES AND LININGS HAVING SEGMENTS WITH SURFACES CONFIGURED TO ABSORB AND RERADIATE HEAT

[75] Inventor: Robert Thomas, Worcester, Great Britain

[73] Assignee: Morganite Thermal Ceramics Limited, Norton, England

[21] Appl. No.: 732,504

[22] PCT Filed: Jun. 7, 1995

[86] PCT No.: PCT/GB95/01313

§ 371 Date: Jan. 30, 1997

§ 102(e) Date: Jan. 30, 1997

[87] PCT Pub. No.: WO95/33964

PCT Pub. Date: Dec. 14, 1995

[30] Foreign Application Priority Data

Jun. 8, 1994 [GB] United Kingdom ..... 9411489

[51] Int. Cl.[6] ..... F27D 1/00

[52] U.S. Cl. ..... 373/137; 373/109; 373/119; 373/122; 392/435; 392/437

[58] Field of Search ..... 373/22, 30, 44, 373/45, 72, 71, 118, 122, 137; 392/407, 432, 433, 434, 435, 436, 437

[56] References Cited

U.S. PATENT DOCUMENTS

| | | | |
|---|---|---|---|
| 2,525,882 | 10/1950 | Ferguson . | |
| 4,435,819 | 3/1984 | Plume | 373/119 |
| 5,218,615 | 6/1993 | Wieland et al. | 373/71 |

FOREIGN PATENT DOCUMENTS

| | | |
|---|---|---|
| 849230 | 11/1939 | France . |
| 1271703 | 8/1961 | France . |
| 1392099 | 2/1965 | France . |
| 732787 | 3/1943 | Germany . |
| 0297449 | 4/1928 | United Kingdom . |
| 0353839 | 1/1930 | United Kingdom . |
| 0971933 | 10/1964 | United Kingdom . |
| 1038498 | 8/1966 | United Kingdom . |
| 1387655 | 3/1975 | United Kingdom . |
| 2055182 | 2/1981 | United Kingdom . |
| 2224563 | 5/1990 | United Kingdom . |

OTHER PUBLICATIONS

Brochure entitled "Morgan Electric Resistance Bale Out Furnace Type HE/BA" (four pages; undated).

Brochure entitled "Morgan High Efficiency Bale Out Furnance" (four pages; undated).

WPI Accession No. 90–355220/48 (English–language abstract of DD 280313).

*Primary Examiner*—Tu B. Hoang
*Attorney, Agent, or Firm*—Dean W. Russell; Kilpatrick Stockton LLP

[57] ABSTRACT

Dual electric/gas heating in a crucible melting furnace with segmental lining, and lining and segments of linings for same, are disclosed.

8 Claims, 7 Drawing Sheets

FURNACES AND LININGS HAVING SEGMENTS WITH SURFACES CONFIGURED TO ABSORB AND RERADIATE HEAT

FIELD OF THE INVENTION

This invention relates to furnace linings and furnaces using them.

BACKGROUND OF THE INVENTION

In gas-powered metal melting furnaces the non-luminous products of combustion heat the lining of the furnace. This lining, or radiant surface, then radiates heat to the crucible. Some heating of the crucible occurs by convection but this on a minor scale unless the gas has a high velocity and this does not tend to occur in this type of furnace.

Conventional linings are made of brick, castable refractory, or ceramic fiber. The lining is provided as a continuous structure and if a refractory failure occurs at any point in the lining the operator of the furnace is invariably obliged to replace the entire lining. This involves shutting down the furnace during the relining process, which takes at least some days, and this incurs costs in addition to the cost of the new lining and the cost of having it fitted. After a new lining has been fitted the furnace must be heated up again which incurs a further use of energy.

The materials used to line conventional gas powered furnaces have specific features as follows:

Brick linings (and the insulation behind the linings) take a considerable amount of time to heat up to the desired temperature. Consequently, they use considerable amounts of energy. Another disadvantage is that the bricks are cemented together into a wall and if even a small area cracks or otherwise fails to provide a uniform heating surface the entire wall must be broken and rebuilt. Thirdly, building brick linings requires specialist brick-laying skills as the bricks must be carefully laid in a short tower-like structure of small diameter (from 0.75 m).

Castable refractory linings are easy to make. However, it is difficult to prepare a reliable castable refractory lining as the refractory material tends to crack and then break up as temperature fluctuations occur at the radiant surface. Castable refractory and dense brick linings have approximately similar heat capacities.

Ceramic fiber linings have advantage in that their heat transfer and thermal insulation properties give thermal efficiency 20% higher than brick or castable linings. However their being fiber requires quite onerous safety precautions be observed during handling. Also, linings comprising ceramic fiber are easily contaminated, for example by metal splashing out of a crucible or glaze from the crucible itself. The fiber can react to form a glass which severely reduces the ability of the lining to radiate heat, and a contaminated lining must therefore be replaced.

Electrically heated furnaces, though the energy is costly, are used as alternatives to gas-powered furnaces. Electric resistance bale-out furnaces for example find application in aluminium and zinc alloy pressure and gravity foundries. As in gas-powered furnaces, the principal mode of heat transfer is radiation. The heater panels and element wires rise in temperature to around 1150° C. when protective controls arrest further increase, and heat is transferred according to the temperature difference and the surface areas of transmitter and receiver.

One type of electrical furnace is type HE Electric Resistance Bale Out Furnace manufactured by the present applicant. The radiant surface of the lining is heated by means of electrical heating elements which are part embedded in a castable refractory. The lining is split into panels, each of which is separately removable so that if a fault develops in one panel, that panel can be replaced without shutting down the furnace.

In both kinds of furnace thermal strain and shock to the crucibles need to be avoided as far as possible and an atmosphere conducive to good melting maintained.

Gas-powered furnaces are generally more economical than electrical furnaces for heating the contents of the furnace to the desired temperature from room temperature as this usually requires a great deal of energy. However, electrical furnaces are advantageous for holding the furnace at the desired temperature. The temperature of the molten metal is critical for producing good-quality castings and electrically-powered furnaces are easy to switch on and off for accurate temperature regulation, for example to ±2° C., using a low amount of energy, a facility not easily available in a gas-powered furnace because the supply of gas cannot be switched on and off sufficiently quickly. Fully modulating, high turn down gas burner systems are complex and expensive by comparison.

SUMMARY OF THE INVENTION

It might seem evident that a furnace brought to temperature by gas heating and maintained there electrically should be provided but this has not been done. We have now seen that using particular features the advantages of gas- and electrically-powered furnaces can be combined for the metal melting crucible furnaces we are concerned with.

Primarily the invention provides a refractory lining for a radiant heating furnace comprising a plurality of lining segments or panels shaped to abut to form a radiant heating enclosure for a metal melting crucible while being individually withdrawable in the event of failure, the segments having a surface configured to absorb and reradiate to the crucible heat from combustion gases passed over the lining in use and at least one and desirably a plurality of the segments being provided with electrical heating elements below the surface of the segment.

A desirable surface configuration of the segments is of multiple spaced projections or protrusions disposed to absorb heat from the combustion gases and radiate it to the crucible, particularly when the protrusions are frusto conical. Such configurations are discussed below, in particular the desirable feature that the surface above the electrical elements, facing the crucible in use, is free of projections. Clear channels between the projections are thus left, with the elements lying beneath them. The surface in the channels may be rounded over the elements, if desired, to ease heat transfer, provided they remain covered.

The invention extends to a metal melting crucible furnace provided with the lining, disposed for impingement of combustion gases from a burner, and to the individual segments, readily withdrawn and replaced axially of the enclosure they form.

Such a furnace provides for an advantageous construction in which the burner is employed for initial heating from cold while the power output of the electrical heating elements, less than that of the burner, is sufficient for operating temperature maintenance, but not adequate for the initial heating. Electrical heating elements within the body of the lining, to avoid attack on the elements by the combustion gases, are readily provided to give such power.

The panels may be made of a castable refractory material, for example a high alumina fine grained refractory, and advantageously having a density of from 1 to 3 g/cc. Densities at the lower end of the range, for example 1.5 g/cc, are preferred as giving quick heating without temperature overshoot. The panels may be made using broadly known casting technology.

The protrusions are designed to allow ready demolding after casting and, in use, to optimize surface radiation and promote combustion product retention whilst withstanding thermal stress. The frusto conical shape referred to, shows the temperature resistance and durability required, but other cross sections are not excluded.

In detail, the purposes of the refractory protrusions include the following:

i. To present a raised surface of low thermal mass (i.e. requiring a low amount of heat to raise its temperature), enhancing the speed at which the lining heats up from room temperature and to limit thermal overshoot. Temperature control is thus improved with such a surface. The remainder of the panel heats up more slowly and stores heat after the gas supply has been turned off.
ii. To provide a large area of radiant surface from a low emissivity gas flame.
iii. To provide some additional residence (i.e. trapping) of gas products in the areas between the protrusions, overcoming the natural buoyancy of the gas products and thereby extracting more energy.
iv. To absorb combustion noise within the furnace cavity thereby reducing emitted noise.

The protrusions are sized to have sufficient definition and strength for the refractory type used and to withstand thermal shock. For example a frusto-conical protrusion may have a base diameter of from 5 to 20 mm, most preferably about 10 mm and a height of from 5 to 20 mm, most preferably about 8 mm, resisting the tendency for the temperature differential in the furnace to break them off the radiant surface.

The pattern of the protrusions is not critical but determines the efficiency of conversion from convective to radiant heat transfer. It is for example advantageous to provide protrusions of the above size at a density on the radiant surface of the panels of from 5000 to 20000 per sq. meter, most preferably about 10000, densities given if the protrusions are on a square grid with center to center spacing matching their diameter. The pattern should further preferably provide horizontal channels to encourage gas products to be retained between the protrusions as they circulate.

The panels are fitted such that they are individually removable and replaceable. Replacement of a panel may therefore be carried out without emptying the contents of the furnace and without cooling the furnace down. A furnace may, for example, have 12 panels of substantially equal dimensions.

Electrical heating is provided by resistance elements situated beneath the radiant surface of the or some of the panels. Preferably, the electrical elements are spiral elements and the outermost parts of the elements are situated at a distance of from 1 to 10 mm, most preferably about 1.5 mm below the radiant surface, the minimum distance largely depending on the grain size of the ceramic but also on the ability of the ceramic to shield the element from combustion gases. The elements are preferentially arranged to protrude above the panel surface by up to half their diameter with a corresponding refractory encasement.

The arrangement provides a dual fuel furnace having a radiant surface with the combined advantages of gas-power economically used to heat the furnace from room temperature to the desired temperature, and electricity used for fine-tuning in holding the furnace at that temperature. The furnace thus has very high efficiency, low melting costs and accurate temperature control.

As noted, the radiant surface of the panels directly above the electrical resistance elements is preferably free of protrusions so that heat generated by the elements can readily be conducted to the surface of the panel and then radiated from the surface. The lack of protrusions above the electrical elements obviates an unnecessary thickness of refractory material above the elements and thus hindrance to transfer of the heat generated by the elements.

The optimum dual fuel furnace has 12 panels, 6 of which are electrically operated, i.e. having the dual energy capability.

As discussed above, to optimize the advantages of gas melting and electric holding, an automatic control system is employed. Because gas is used only for melting, a very simple burner can be used with basic on/off control. This simplicity brings with it additional reliability due to fewer functional components.

When temperatures approach those required for the casting process and accurate control becomes necessary, electricity is used for the heating energy source.

The input power can be proportioned accurately to demand, with resultant close temperature control, using either contactor time proportioning or thyristor switching with a PID controller (proportional integral derivative '3 term' control).

Because PID type temperature control requires quick and frequent switching, it has to be avoided during gas operation due to the time constants associated with flame supervision.

The controller employed has "gain scheduling" which permits PID terms to be introduced at selected temperatures. In this way, during gas burner operation, the proportional band is set to zero, providing on/off control only. At a preset temperature, gas melting is switched off and electric heating switched on. Beyond this temperature, at a value determined to give best control, the gain schedule introduces the appropriate proportional band (typically 3%) together with suitable values for the integral and derivative terms. This then gives accurate temperature control around the desired "set point", typically ±2° C. at 720° C.

To provide maximum flexibility a key switch can further select either gas only or electric only. This feature can permit maintenance to be carried out, for example, on the gas burner, without interrupting production or necessitating removal of molten metal.

BRIEF DESCRIPTION OF THE DRAWINGS

Furnaces and linings according to the invention are described by way of example with reference to the attached drawings, in which.

DETAILED DESCRIPTION

Figure 1:
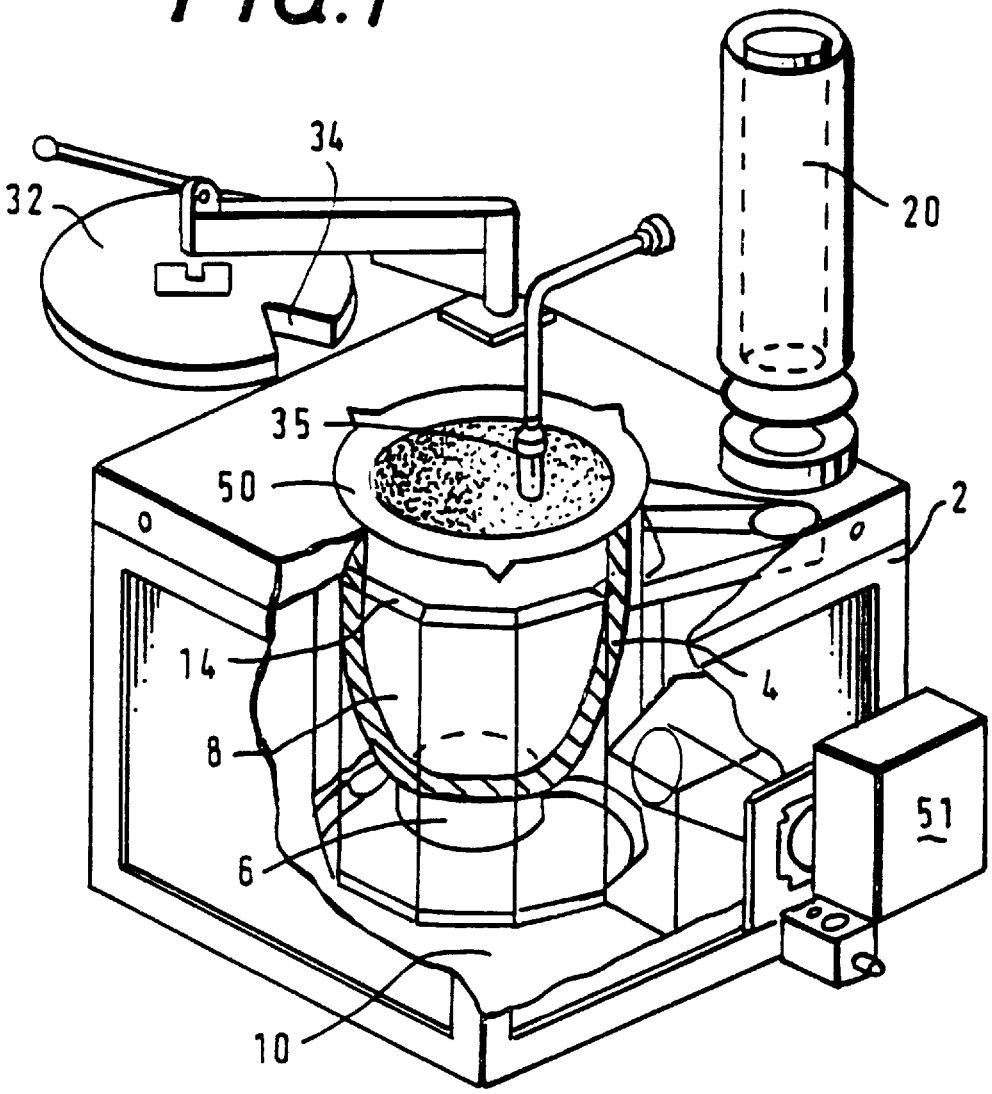
FIG. 1 shows a cut-away view of a furnace.
Figure 2:
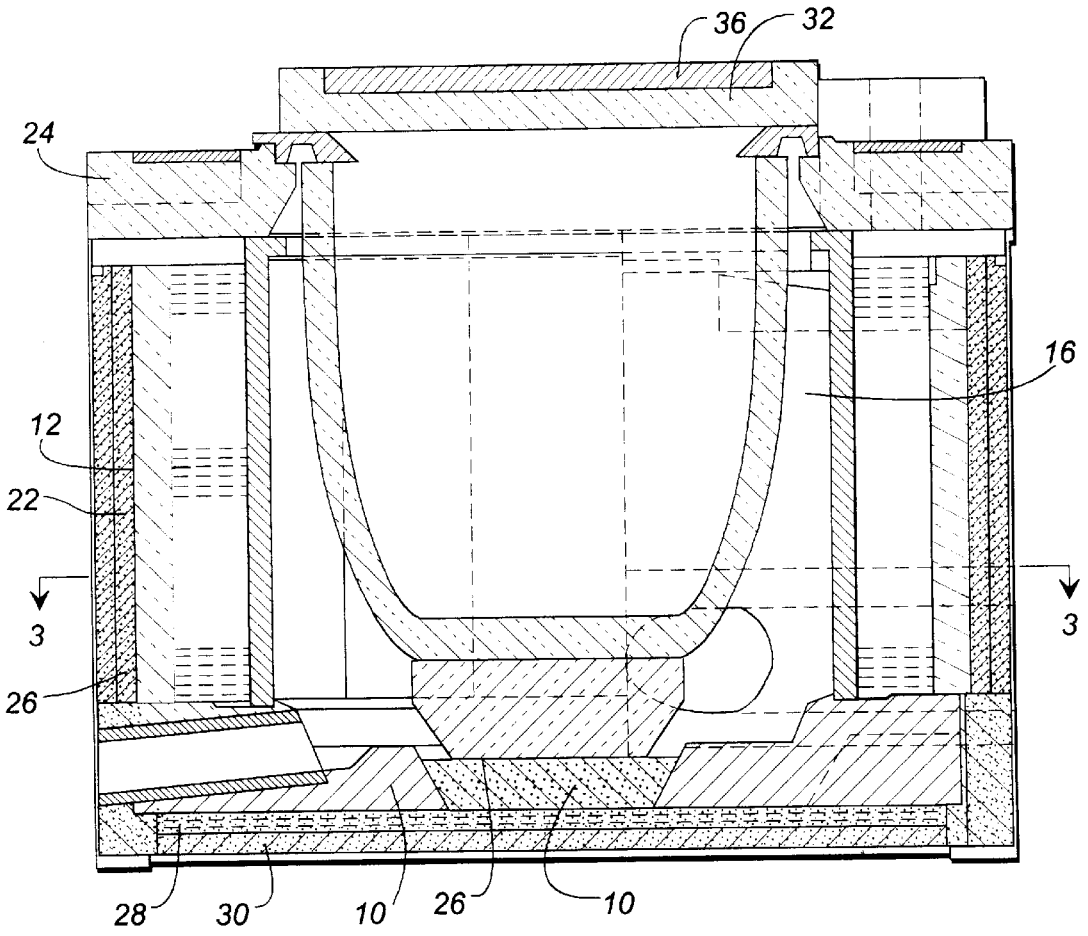
FIG. 2 shows a vertical sectional view.

The furnace body 2 shown in FIGS. 1 and 2 is substantially square in plan through other shapes for example circular are also possible. Dimensions and height depend upon capacity and crucible size. Standard crucible capacities range from 135 kg to 1130 kg of aluminium.

The body 2 comprises a robust steel shell and contains the crucible 4 with stand 6; radiant heater panels 8, pre-cast base 10 and layered insulation 12.

Figure 3:
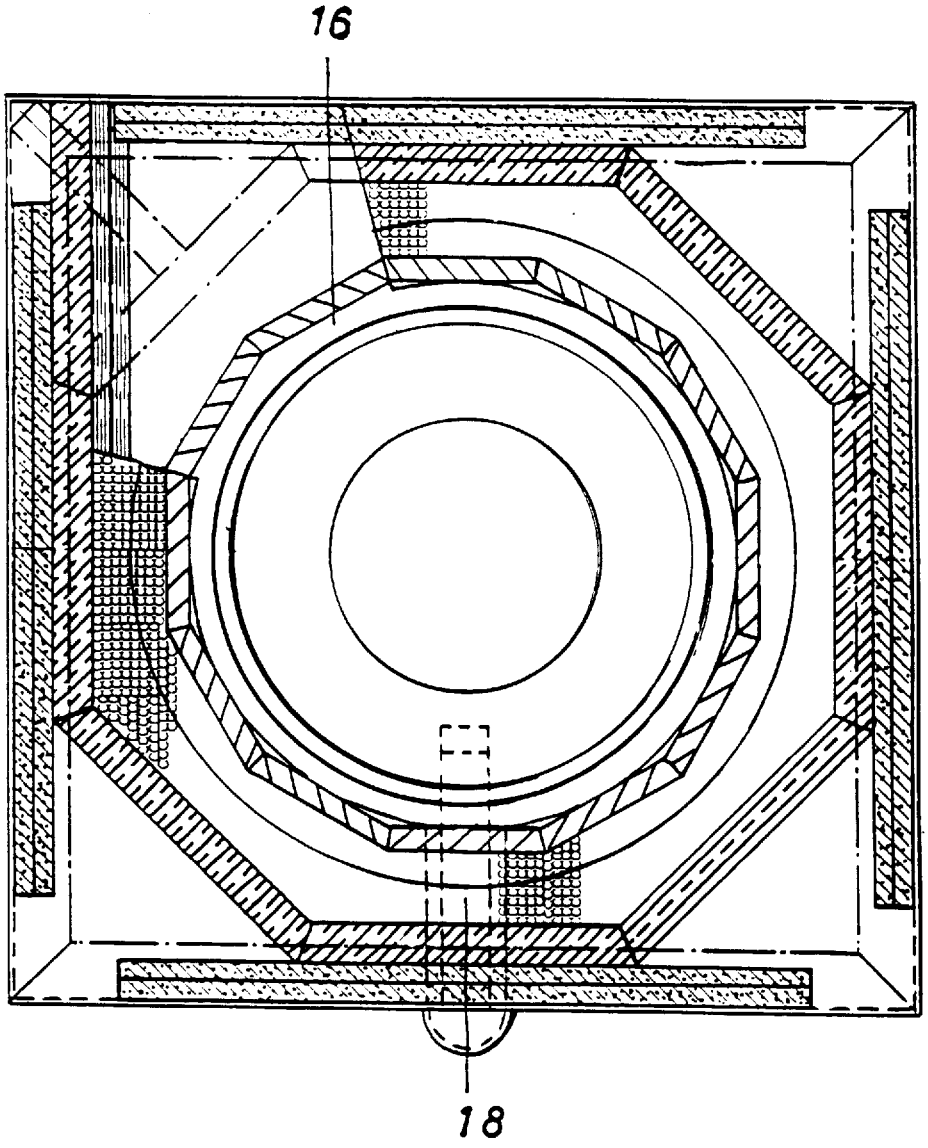
FIG. 3 shows a sectional view on A–A' in FIG. 2.

The radiant heating panels 8 form a regular 12-sided figure (best seen in FIGS. 1 and 3) and have a lifting edge (or ledge) 14 at the top to allow easy removal and provide additional retention of combustion products.

The panels 8 are pre-cast, in a mullite based or high alumina fine grained refractory, and have raised protrusions on the radiant face. (See FIGS. 5–7).

Hot gases enter the radiant cavity 16 via a precast refractory tunnel 18 into which a gas burner 51 fires. The waste gases leave the furnace through an exhaust opening 20, formed partly in the furnace body refractory and partly in the furnace cover. An exhaust extension channels waste gases away from any operator access and may be provided with two skins to reduce the surface temperature.

Insulation 12 between the panels and the furnace shell (FIG. 2) is in the form of graded layers to keep heat loss to a minimum. For example, as shown in the drawings, ceramic fiber bulk (12) may be used immediately behind the radiant panels. This contains a wax binder which is driven off during the first firing of the furnace leaving a solid self-supporting structure. This enables the panels to be subsequently exchanged if required. Behind the ceramic fiber (12) lies a rigid support material 22 which helps to support the top capping refractory 24. The rigid support is preferably a calcium silicate board. At the furnace casing, a microporous insulator 26 is used to minimize thermal losses. The furnace corners beyond the calcium silicate board are filled with ceramic fiber 12.

The base 10 consists of four pieces pre-cast using two grades of refractory in order to combine high temperature duty with optimum insulation. The four segments are gasketed with ceramic fiber blanket 26. Beneath the base refractory are layers of microporous insulation 28, 30, again to minimize losses.

The furnace top cover 32 (FIG. 1) is made of a castable refractory formed to provide a crucible opening and a sealing surface, together with aperture 34. Behind the castable refractory, a microporous insulator 36 (FIG. 2) reduces surface temperature and heat losses.

The crucible is protected by a one-piece heat resisting cast iron ring 50 (FIG. 1) with supporting ears. In some cases, the ring is machined to accept a crucible pyrometer 35 of known type.

A thermocouple may be positioned against the back of one or more panels to protect the panels from overheating and to place a limit on chamber temperature. The thermocouple feeds a limit temperature controller which prevents both gas or gas-electric panels from operating, should set temperature be exceeded. This is important to prevent excess temperature from damaging the electrical heating elements.

The temperature of the metal charge is monitored, for example, by the immersion pyrometer 35 (FIG. 1,) feeding a temperature controller.

Figure 8:
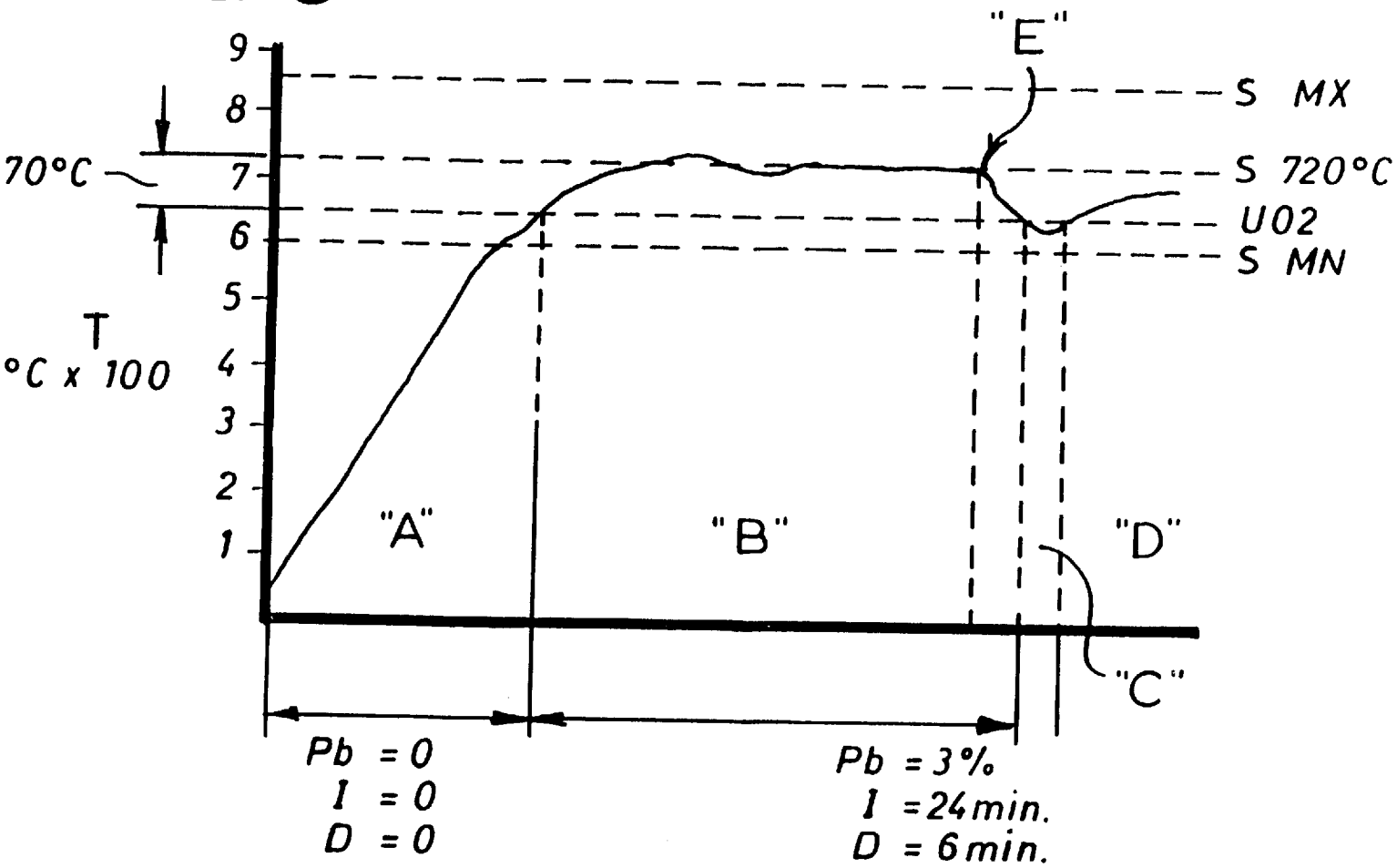
FIG. 8 is a dual energy control diagram.

The controller can be switched to an "electric holding" setting which allows the controller to proportion heat input through a contractor on a time cycle basis. The gas burner is generally but not exclusively a simple on/off type. Such control is diagrammatically set out in FIG. 8, time against temperature with initial gas heating at "A", electrical heating at "B" and "D", and a brief period of gas heating at "C" after addition of cold metal at "E" has lowered the temperature.

The meanings of the abbreviations are:

| | |
|---|---|
| S MX | set point maximum |
| S MN | set point minimum |
| S 720° C. | set point median |
| UO2 | Universal output 2 (configured as a low deviation alarm (70° C. deviation), a relay output operating at the UO2 setting) |
| Pb | Proportional band |
| I | Integral term |
| D | Derivative term |
| Zero values give on/off control. | |
| T | Temperature °C. × 100 |

There is additionally a mimic diagram on the control panel (not shown) showing the position of the radiant heating panels. Each position carries an indicator (for example amber neon) which illuminates or otherwise indicates when the gas burner fires. When heating electrically, LED indicators illuminate the appropriate mimic panels, driven by the heating current. The corresponding LED extinguishes in the event of failure of an electrically-driven panel, thus providing an indication of the position of the failed panel in the heater array.

Figure 4:
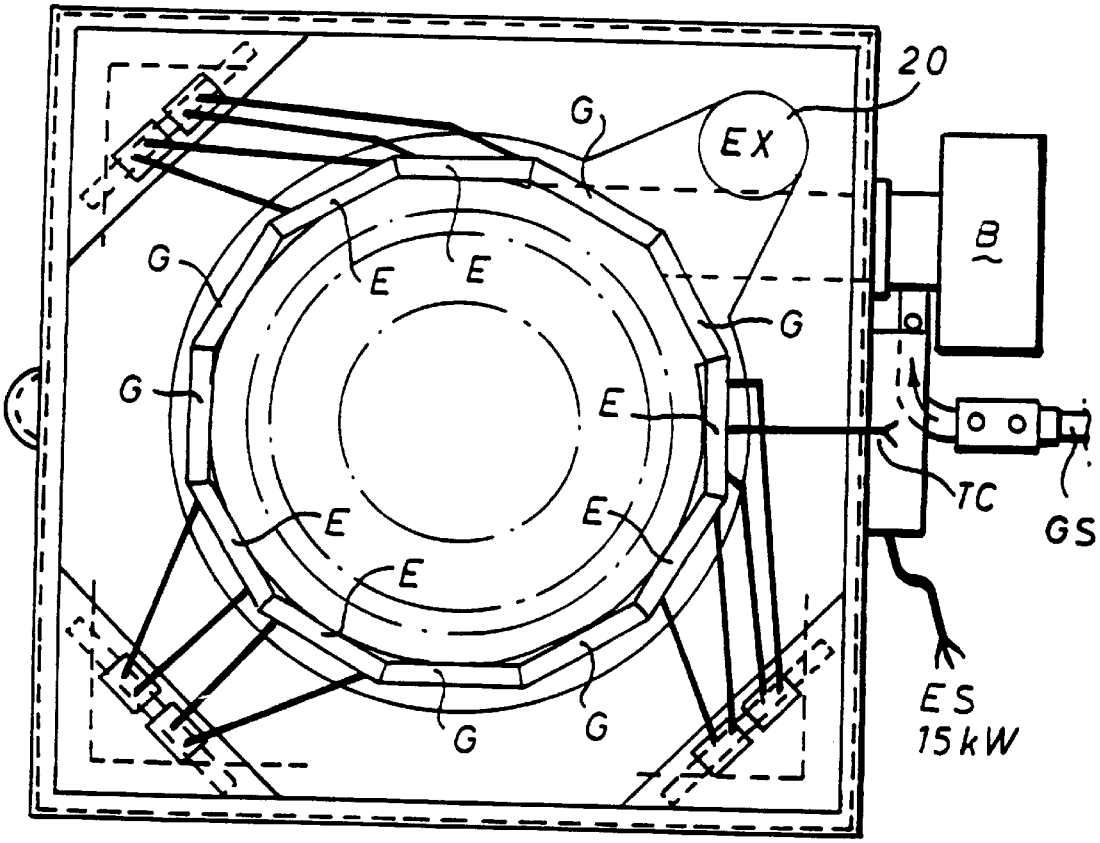
FIG. 4 shows a plan view of another furnace.

The preferred arrangement of panels is shown in FIG. 4. The furnace is provided with 12 panels 8, six of which provide radiant heat from gas only (panels "G") and six of which are provided with electrical resistance heating elements just below the surface of the panels ("E"). The electric radiant panels may be positioned as shown in three equispaced sets of two panels or in other arrangements, with electrical connections as schematically indicated. In FIG. 4 further, EX is the exhaust flue, B the gas burner and GS its gas supply, ES is the electricity supply (15 kW total for the size), and TC the temperature control.

Figure 6:
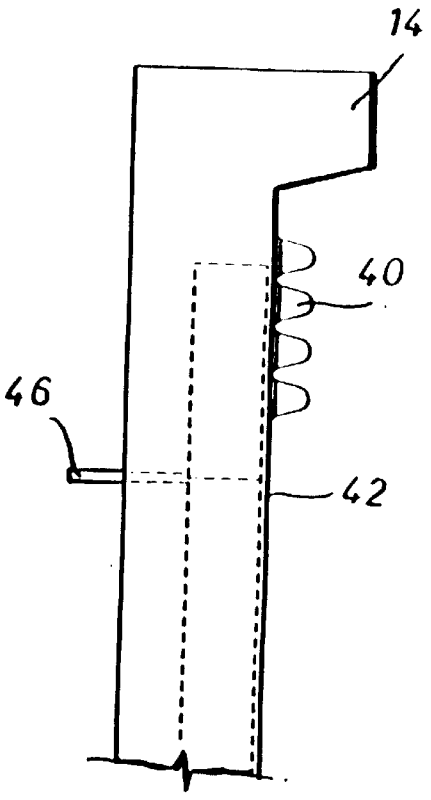
FIGS. 5, 6 and 7 show partial front, side and plan views of dual energy panels.
Figure 5:
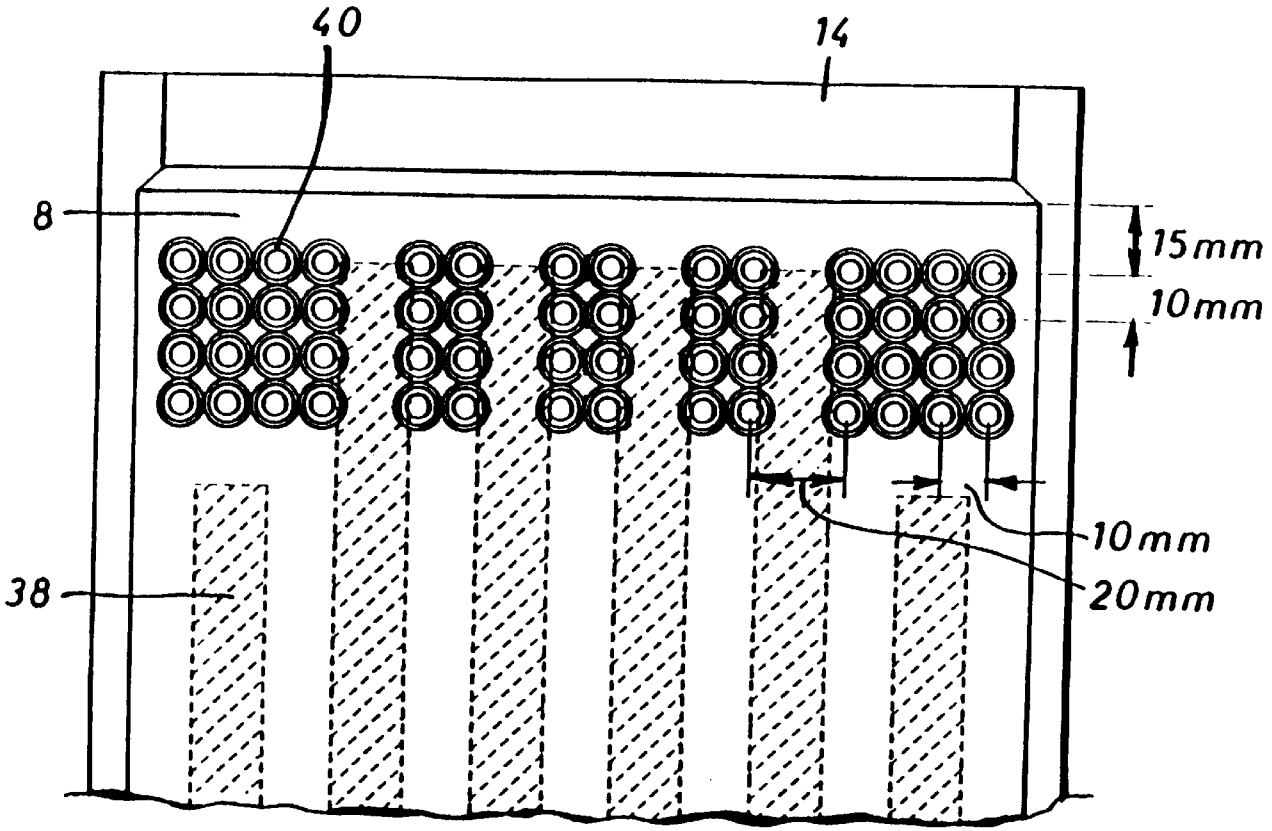
Figure 7:
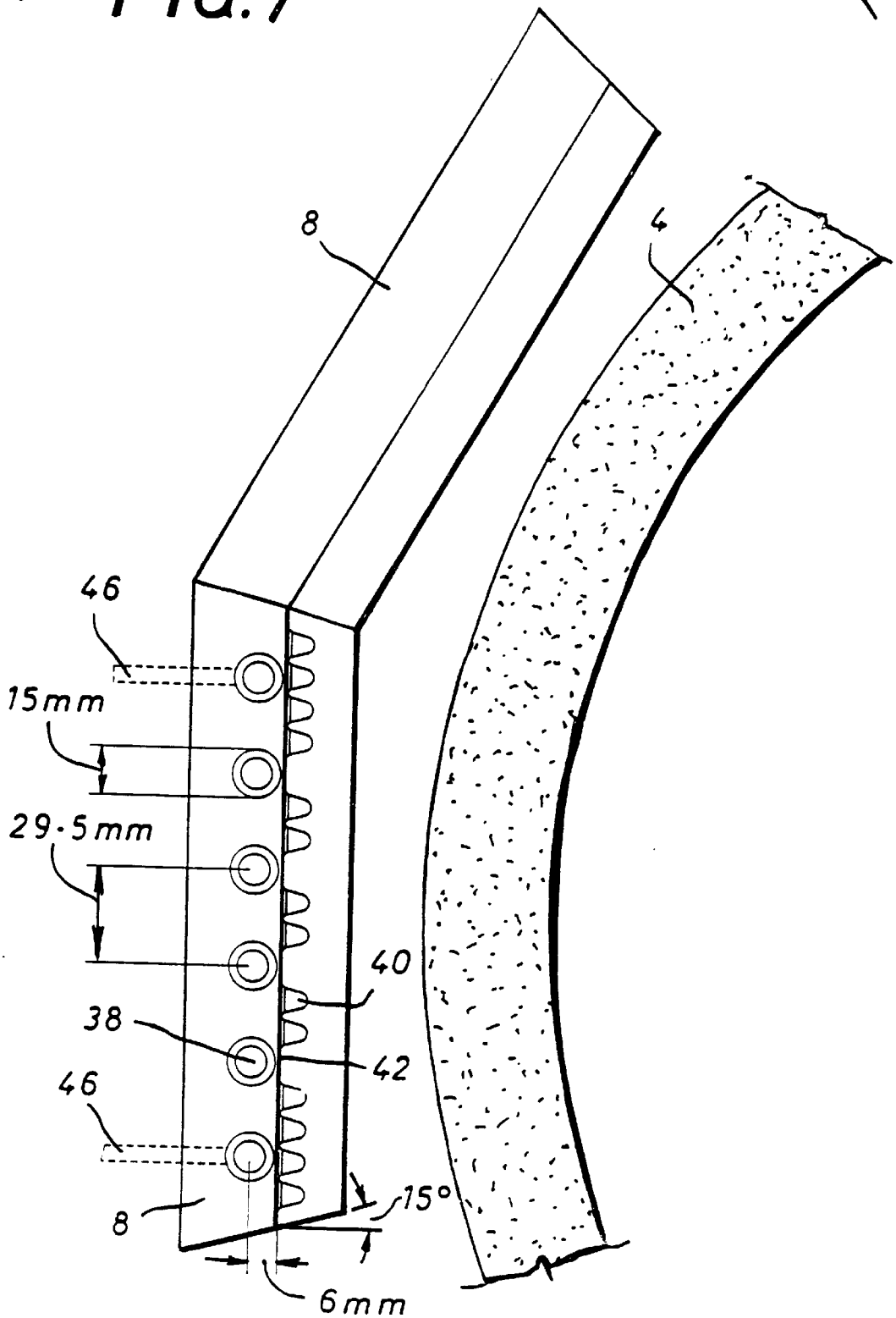

The preferred configuration of the panels, is shown in FIGS. 5 to 7.

FIG. 5 shows part of the radiant heating face of a dual gas-electric panel in detail. The shaded areas 38 represent the areas underneath which lie the electric heating elements. Protrusions 40 are provided on the radiant surface 42 (see FIG. 6) of the panel. They are at 10 mm center, the top 4 rows only being shown (there are 51 rows in all of this size). The included angle of the flanks of the protrusions is 30°. No protrusions are provided directly above the electric heating elements, i.e. in the shaded areas 38, to maximize power density. A gas-only panel without electrical elements has similar protrusions but all over the radiant surface of the panel, 18 columns as opposed to 14 on the dual panels. A ledge 14 is provided at the upper edge of the panel to facilitate insertion and removal of the panel and if this ledge emerges from the surface towards the crucible over the protrusions (as shown in FIG. 6) then it helps to retain the gas products and heat.

The dual panel contains a fully embedded (submerged) heater element, preferably a spiral element in an iron-chrome-aluminium alloy (FeCrAl) which can be used up to 1300° C. The overall panel surface watt loading has a maximum of about 2.3 watts/cm$^2$ (15 watts/inch$^2$).

Power is connected to the heater, for example, by two multistranded nickel chrome (NiCr) tails (one shown as 46 in FIGS. 6 and 7) with either crimped or welded lugs. The tail lugs connect to terminals at the furnace corners, where they are wired to the controlling power circuit furnace cabling. High temperature cable connects from furnace corner terminals to the main terminal box. A pre-wired cable harness interconnects the furnace terminal box and the furnace control panel.

Working prototypes of the panels have been prepared having the following characteristics and dimensions:

Gas only (51 rows of substantially frusto-conical protrusions in 18 columns)

| | |
|---|---|
| Width of panel | 190 mm |
| Height of panel | 591 mm |
| Thickness of panel | 30 mm |
| Horizontal depth of ledge extending over protrusions | 20 mm |
| Full horizontal depth of ledge including panel | 50 mm |
| Vertical extent of ledge | 20 mm |
| Horizontal and Vertical distance between tips of adjacent protrusions | 10 mm |
| Radius of base of protrusion | 2.5 mm |
| Base chamfer | 1 mm by 45° |
| Height of protrusions | 8 mm |
| Angle of convergence of sides of protrusions | 30° |
| Smallest distance of protrusions from face of crucible | 45 mm |

Gas/Electric

The gas/electric panels have the same characteristics and dimensions as set out above for the gas only panels except that, as shown in FIG. 5, some of the columns or parts of columns of protrusions are missing and the heating elements are submerged under these areas which may be in the general plane of the panel surface as shown or constitute raised rounded flutes.

The electrical elements are shown in FIG. 7 and in the working prototype had the following characteristics and dimensions:

| Six spiral heater elements equally spaced across one panel: | |
|---|---|
| Distance between center of adjacent elements | 29.5 mm |
| Diameter of elements | 15 mm |
| Depth of center of element below radiant surface of panel | 9 mm |
| Clearance of element below radiant surface of panel | 1.5 mm |

Safety features including a sensitive core balance earth leakage detector to monitor the output electric circuit were incorporated. Should an earth fault exceeding 30 mA occur for longer than 30 milli seconds the controlling circuit opens to remove the furnace supply.

A furnace in the range 175–300 kg aluminium capacity would typically have powers as follows:

| | | |
|---|---|---|
| 1. | Electric | 46–54 kWh/hour |
| 2. | Gas | 132 kWh/hour (4.5 therms/hour) |
| 3. | Gas/Electric | Gas 132 kWh/hour, up to 180<br>Electric 15 kWh/hour |

Data for the furnace shown in the drawings is given below:

| | |
|---|---|
| Capacity | 250 kg aluminium |
| Heat input | 4.3 therms/hour (melting phase) |
| First Melt Time | To 720° C.–178 mins |

-continued

| | |
|---|---|
| Subsequent Melt Time | To 720° C.–133 mins |
| Holding Consumption | Covered 0.25 therms/hour<br>Uncovered 0.9 therms/hour |
| Maximum Melt Rate | Covered 133 kg/hour<br>Uncovered 122 kg/hour |
| Dimensions | Width 1190 mm<br>Depth 1190 mm<br>Height 900 mm |

Table 1 below shows the comparative performance and resultant cost saving (in £ Sterling) of the prototype dual fuel furnace "MK IV Gas Bale-out (BO)" against existing furnaces of similar dimensions and manufactured by the present applicant "Gas HEBO 302" is a gas-fired furnace with a ceramic fiber lining and "HE ERBO 46 302" is a 12-panel electrical furnace.

The furnace according to the invention has several benefits:

i. The known 12-panelled electrical furnace and the furnaces according to the invention have many common parts, leading to ease of manufacture and maintenance.

ii. As discussed, the gas burner used on the dual energy furnace is cheaper and more reliable than on a conventional furnace because it need not be capable of holding the temperature at a desired level.

iii. Longer crucible lifetime is expected than in conventional gas fired furnaces. At present, crucibles in existing electrical furnaces have an average lifetime of approximately 6 months—50% longer than crucibles in existing gas-powered furnaces which have an average lifetime of approximately 4 months. This is because the gas furnaces are not particularly efficient at converting the convection currents of the gas products to radiant heat and so large temperature gradients exist between the gas inlet at the base of the furnace and the relatively cooler conditions in the upper part of the furnace. In the new furnace, even heating across the radiant surface, and improved control of chamber temperature, mimic very closely the conditions prevailing in the existing electric furnaces. It is estimated that crucible lifetimes will approach those in electrical furnaces.

iv. The individually exchangeable, modular panel design allows ease of replacement if an area of the radiant surface should fail or a localized refractory problem develop. The furnace can be turned off, the cover lifted and the panel lifted out and new one inserted. It is not necessary to shut down the furnace, empty the crucible, destroy the existing lining and then rebuild it. This provides excellent flexibility and saves maintenance time and therefore running costs.

v. A high standard of safety can be achieved. The prototype burner tested conforms to British Standard BS 5885/1 and has full flame failure protection. Exhaust gases are carried away through a concentric tube exhaust extension. Generally, the furnace conforms to the European Machine Directive EN 7461 for "CE" marking. Noise output from the furnace is low when gas firing, being less than 80 DBA at 2 meters.

I claim:

1. A refractory lining for a radiant heating furnace comprising a plurality of lining segments or panels shaped to abut to form a radiant heating enclosure for a metal melting crucible while being individually withdrawable in the event of failure, the segments having a surface configured to absorb and reradiate to the crucible heat from combustion gases passed over the lining in use, and at least one of the segments being provided with electrical heating elements below said surface of the segment.

2. A lining according to claim 1, in which configuration of said surface is of multiple spaced projections disposed to absorb heat from the combustion gases and re-radiate it to the crucible.

3. A lining according to claim 2, in which the projections are frusto conical.

4. A lining according to claim 2 or 3, in which said surface is free of the projections in the part above each element.

5. A set of segments or panels for a refractory lining for a radiant heating furnace, the segments being shaped to abut to form a radiant heating enclosure for a metal melting crucible while being individually withdrawable in the event of failure, each segment having a surface configured to absorb and reradiate to the crucible heat from combustion gases passed over the lining in use, and at least one of the segments being provided with electrical heating elements below said surface of the segment.

6. A furnace provided with a lining, according to claim 1, disposed for impingement of combustion gases from a burner.

7. A furnace according to claim 6, wherein the burner is suited to initial heating from cold while the power output of the electrical heating elements is less than that of the burner, sufficient for operating temperature maintenance but not initial heating.

8. A lining according to claim 4, in which said surface forms a rounded flute covering the element.

* * * * *